United States Patent [19]

Smith, Jr.

[11] Patent Number: 4,970,111

[45] Date of Patent: Nov. 13, 1990

[54] FLAME RETARDING FUSION BONDED NON-WOVEN FABRICS

[76] Inventor: W. Novis Smith, Jr., 412 South Perth St., Philadelphia, Pa. 19147

[21] Appl. No.: 256,490

[22] Filed: Oct. 12, 1988

[51] Int. Cl.[5] ..... B32B 5/16

[52] U.S. Cl. ..... 428/283; 428/280; 428/284; 428/288; 428/296; 428/369; 428/902; 428/920

[58] Field of Search ..... 428/288, 280, 296, 902, 428/283, 284, 920, 369

[56] References Cited

U.S. PATENT DOCUMENTS

| | | | |
|---|---|---|---|
| 3,801,428 | 4/1974 | Striegler et al. | 428/359 |
| 4,127,698 | 11/1978 | Shimizu et al. | 428/359 |
| 4,194,037 | 3/1980 | Stoller | 428/300 |
| 4,588,635 | 5/1986 | Donovan | 428/288 |
| 4,748,075 | 5/1988 | Beyer et al. | 428/288 |
| 4,751,134 | 6/1988 | Chenoweth et al. | 428/288 |
| 4,888,235 | 12/1989 | Chenoweth et al. | 428/283 |

*Primary Examiner*—James J. Bell
*Attorney, Agent, or Firm*—John Lezdey

[57] ABSTRACT

A fire resistant, non-dripping, fusion bonded, non-woven fabric or fabric structure comprising a synergistic blend of about 35 to 80% by weight of chlorine-containing polymeric fibers, about 2 to 25% by weight of stabilized polyacrylonitrile fibers and about 10 to 55% by weight of a fire retarding polyester binder.

17 Claims, No Drawings

FLAME RETARDING FUSION BONDED NON-WOVEN FABRICS

FIELD OF THE INVENTION

The present invention relates to flame retarding structures and fabrics. More particularly, the invention is concerned with fusion bonded non-woven structures and fabrics comprising a blend of chlorine containing fire retarding fibers with non-fusing fibers and a high melting fire retarding polyester which have a synergistic fire resistant effect for use in protective clothing such as for firefighters or hazardous equipment handlers.

BACKGROUND OF THE INVENTION

The prior art has used asbestos, carbon and graphite short straight staple felts, and various ceramic materials, particularly ceramic foams as thermal insulation having fire blocking properties. The bulk densities of some of the well known thermal insulating materials are in the range of 0.35 to 2 pounds per cubic foot (5.6–32.04 kg/m$^3$) for insulating materials useful at temperatures not exceeding 120° C., and from 2 to 5 pounds per cubic foot (32 to 80 kg/m$^3$) for the high temperature (about 3000° F.) insulating materials. Even the newest "light weight" insulating material recently disclosed comprising a ceramic from which a carbonaceous material has been burned out has a bulk density of about 2 to 6 pounds per cubic foot (32 to 96 kg/m$^3$).

In addition, with the possible exception of fiberglass, which may be used under certain conditions as a fire block, the common thermal insulating materials having fire block properties (such as carbon or graphite felts and ceramic materials) do not have any resiliency, i.e., they do not have the ability to recover from compression of the original loft.

Both government and industry have conducted extensive research into developing fabrics that would either be non-flammable or at least retard the propagation of a fire. In conjunction with finding an effective material to act as a fire barrier, consumer considerations require that any such materials to be functional, aesthetically acceptable and reasonably priced.

Unfortunately, past efforts to develop a suitable fire resistant fabric have not been very effective. Thus, even fabrics that will not ignite from a smoldering cigarette and that are considered to be class 1 fabrics under the UFAC upholstery fabric classification test will burn when placed in contact with an open flame. Consequently, this leads to the ignition of an underlying batting in a cushion or mattress.

So-called fire retardant foam coatings for draperies, liners and backcoatings for upholstery, as well as chemical treatments for apparel fabrics that attempt to provide a fire retardant quality to the fabric, are commercially available. Unfortunately, these materials are often lost during laundering and are, at best, self extinguishing only when the source of the flame is removed. If the flame source is not removed, these materials will char, lose their integrity and, most importantly, will not prevent the flame from reaching materials underneath the fabric covering which act as a major source of fuel for the fire.

Other attempts at solving the flammability problem have centered on the use of inherently non-flammable fabrics such as fiberglass which can be used, for example, in draperies. It is known, however, that the glass fibers are self abrasive in that they rub against each other, thereby becoming self-destructing due to the abrasive action. Thus, hand washing and line drying is, out of necessity, the recommended cleaning procedure for such fabrics. Moreover, the brittle and broken glass fibers tend to be very irritating to the skin, thus rendering any of the applications of the fabric unsuitable where there is extensive skin contact. Fiberglass fabrics usually contain flammable sizing binders and/or finishes to provide an aesthetic appearance.

Consequently, there is a need for fabrics, battings and the like which not only provide fire shielding properties but also are light weight and can be fabricated into aesthetically acceptable fabrics for clothing, home, and commercial use. More particularly, there is a need for low cost, disposable, fire resistant, non-woven, fusion bonded fabrics which are easy to manufacture.

U.S. Pat. No. 4,588,635 to Donovan discloses light weight thermal insulation material which is a blend of spun and drawn, crimped, staple, synthetic polymer microfibers having a diameter of from 3 to 12 microns, and synthetic polymeric staple microfibers having a diameter of more than 12 and up to 50 microns. However, the insulation material is flammable.

U.S. Pat. No. 4,167,604 to Aldrich discloses the use of hollow polyester filaments in a blend with fowl down in the form of a multiple ply carded web which is treated with a thermosetting resin to form a batting having thermal insulating characteristics. The web, however, does not have fire retarding characteristics.

U.S. Pat. No. 4,198,494 to Burckel, which is herewith incorporated by reference, discloses a fiber blend of poly (m-phenylene isophthalamide) and poly (p-phenylene terephthalamide) in combination with a fire resistant polyester that can be used in the present invention. The fiber blend can be used to produce a light weight garment; however, the fabric produced from the blend is costly.

SUMMARY OF THE INVENTION

The invention relates to fire resistant, non-dripping, fusion bonded, non-woven fabrics and fabric structures comprising a synergistic blend of fibers consisting of chlorine containing fire retarding polymeric fibers, non-fusing fibers and a fire resistant, high melting polyester or polyester binder. More particularly, the fabric and fabric structures of this invention comprise about 35 to 80% by weight of the chlorine containing fibers, particularly polyvinyl chloride fibers, preferably about 40 to 70% by weight; about 2 to 25% by weight, preferably about 15% by weight of non-fusing fibers; and about 10 to 55% by weight of high melting polyester or polyester binder.

The chlorine containing polymers also act as a binder. The polymers include films, powders or coatings. The chlorine containing polymers which act as binders include chlorinated polyvinylidene polymers such as polyvinylidene dichloride, chlorinated polyethylene, etc.

The non-fusing fibers utilized in the present invention preferably comprise fibers selected from the group consisting of oxidized polyacrylonitrile fibers (OPF), fiberglass, aramid (Kevlar, Nomex) and polybenzamidazole (PBI).

It has been found to be advantageous to include up to 30% by weight of fiberglass so as to reduce the cost of the fibers. In order to overcome the prior disadvantages of using fiberglass in fabrics which are used for clothing, it has been found to be effective to size the fiberglass before incorporation into the blend of fibers with a suitable thermoplastic material, for example, polyvinyl chloride, nylon, and the like. The sizing has been found effective to retard breakage and protrusion of the fiberglass and to substantially eliminate the irritation of protruding fiberglass.

The non-fusing fibers utilized may be either linear or crimped. The crimped fibers permits use of a lower amount of other non-fusing fibers. High amounts of the fiber are not required for increased fire resistant properties because of the synergism with the chlorine containing polymers. With crimped non-fusing fibers such as OPF fibers, there is a greater coverage and overlap of fibers to provide increased synergism with respect to fire resistance.

The addition of up to 15% of an aramid, for example Kevlar or Nomex, provide the fabric with additional strength and abrasion resistance, but increases the costs.

The polyesters of choice soften at a temperature between 125° and 200° C., preferably 165° to 200° C. The commercially available binders may also be used and include Dupont's type 900F Dacron fire retarded polyester, Grilene (trademark of Ems-Grillon SA), Darcron D171W (trademark of E.I. duPont de Nemours), Fortrel, polypropylene sold under the trademark Danalslon by Danalslon A/S, and the like. Other suitable binders are disclosed in *Nonwoven Industry*, June 1987, pages 26–45, which is herein incorporated by reference.

The binders may also include the additions of non-fusing fire resistant powders such as antimony oxide, Teflon powder, aluminum trihydrate, Carbosil (trademark) and polyvinyl chloride powder in amounts up to about 10% by weight to prevent the fiber from dripping under high heat conditions.

The non-woven fabrics of the invention can be prepared by any conventional fusing bonding methods such as extrusion into sheets, meltspun, pressed, etc. According to one method, the fibers are blended and any powders to improve the fabric characteristics are added. The fiber mixture is placed on a flat plate press, heated until softening of the binder and then subjected to pressure to obtain fusion.

The fabric may be single ply for light weightness or can be multi-plied for fabrics used in curtains. Increased plies and fusing under high pressures produce stiff fire resistant panels.

The precursor stabilized acrylic filaments which are advantageously utilized in preparing the oxidized polyacrylonitrile fibers of the invention are selected from the group consisting of acrylonitile homopolymers, acrylonitrile copolymers and acrylonitrile terpolymers. The copolymers and terpolymers preferably contain at least about 85 mole percent of acrylic units, preferably acrylonitrile units, and up to 15 mole percent of one or more monovinyl units copolymerized with styrene, methylacrylate, methyl methacrylate, vinyl chloride, vinylidene chloride, vinyl pyridene, and the like.

Preferred precursor materials for the oxidized polyacrylonitrile fibers are prepared by melt spinning or wet spinning the precursor materials in a known manner to yield a monofilament or multi-filament fiber tow. The fibers or filaments are formed into a yarn, woven cloth, fabric knitted cloth and the like by any of a number of commercially available techniques, heated, preferably at a temperature between 225°–270° C. in air and thereafter deknitting and carded.

The preferred oxidized polyacrylonitrile fibers which may be used in the invention are commercially available from RK Carbon Fibers Inc. of Philadelphia, PA under the trademark PANOX. The fibers have a Limited Oxygen Index (LOI) of about 55 and a specific density of 1.35–1.4.

The fabrics of the invention can be manufactured by any conventional method which utilizes non-woven fabrics. The fabrics can be used for protective clothing, bedding, etc.

DESCRIPTION OF THE PREFERRED EMBODIMENT(S)

The fabric of the invention may be prepared by intimately blending about 55 to 75% by weight of polyvinyl chloride fiber with about 5 to 15% by weight of stabilized polyacrylonitrile fiber together with about 2 to 20% by weight of binder fibers comprising flame resistant, high melting, polyolefin or polyester. The fiber mixture may then be pressed on a hot plate at a temperature at which the binder fibers soften and at a suitable pressure depending on the ratio of the mixtures and the number of plies utilized.

Fiberglass may be added to the mixture together with or in place of some of the stabilized polyacrylonitrile (OPF) so as to reduce the cost of the fabric. Preferably, the fiberglass is sized with a thermoplastic material prior to blending if the fabric is to comprise clothing. However, Kevlar may be added to the mixture with or in place of the OPF or fiberglass.

Advantageously, the fiber mixture prior to bonding is sprayed with a powder, preferably antimony oxide, aluminum trihydrate or Teflon when preparing fabric for clothing so as to and in preventing melt dripping in fire.

Examplary of the fabrics of the present invention which can be formed into the various structures are set forth in the following examples. It is understood that the percentages referred to herein relate to percent by weight.

EXAMPLE I

A series of samples of non-woven fabric were prepared by hand blending the fiber mixtures and placing them between two glass plates. The plates are then placed in a heated press where the temperature is raised to soften the fibers and under slight pressure to obtain fusion.

The non-flammability of the fabric of the invention were determined following the test procedure set forth in Federal Test Method Standard No. 191A, (5903) which is herewith incorporated by reference. The test was performed as follows:

A minimum of five rectangular 2¾ inches (70 mm) by 12 inches (305 mm) panels were prepared. Each specimen was supported vertically and exposed to a Bunsen or Turill burner with a nominal I.D. tube adjusted to give a flame of 1½ inches (3.81 cm) in height by a calibrated thermocouple pyrometer in the center of the flame was 1500° F. The lower edge of the specimen was ¾ inch (1.91 cm) above the top edge of the burner. The flame was applied to the center line of the lower edge of the specimens for 12 second and then removed.

The char length of the sample were measured. A char length greater than 3.5 inches failed the test. The results are shown in Table I.

TABLE I

| Sample No. | Sample Composition | % Weight | Char Length (in.) | Pass or Fail |
|---|---|---|---|---|
| 1 | PVC/VIN/PAN/PE | 50/10/15/25 | 5 | failed |
| 2 | VIN/PAN/PE | 50/15/35 | 6.75 | failed |
| 3 | VIN/PVC/PAN/PE | 25/25/15/35 | 5 | failed |
| 4 | PVC/VIN/PAN/PE | 50/10/15/25 | 5 | failed |
| 5 | PVC/VIN/PAN/PE | 45/10/15/30 | 7.25 | failed |
| 6 | PVC/NOM/PE | 50/10/40 | 4.5 | failed |
| 7 | PVC/NOM/PE | 50/20/30 | 4 | failed |
| 8 | PVC/NOM/PE | 40/15/45 | 5.5 | failed |
| 9 | PVC/PAN/KEV/PE | 50/10/10/30 | 3.5 | passed |
| 10 | PVC/PAN/PE | 60/10/30 | 3.5 | passed |
| 11 | PVC/PAN/PE | 60/20/20 | 3.5 | passed |
| 12 | PVC/PE/GL | 60/30/10 | 1.5 | passed |
| 13 | PVC/PAN | 90/10 | 3.75 | failed |
| 14 | PVC/PAN | 80/20 | 2.75 | passed |
| 15 | PVC/GL | 70/30 | 2 | passed |
| 16 | PVC | 100 | 4 | failed |
| 17 | PVC/PE | 80/20 | 6 | failed |
| 18 | PVC/PE | 20/80 | burned | failed |
| 19 | PE | 100 | burned | failed |

KEV = Kevlar
PVC = Polyvinyl Chloride
NOM = NOMEX (m-aramid)
PAN = PANOX (stabilized polyacrylontrile)
PE = Polyester (Fortrel 398)
VIN = VINYON (low melt polyester)
GL = Fiberglass

Conclusions

The use of the stabilized polyacrylonitrile fibers in lieu of the glass or aramid fibers (KEVLAR, NOMEX) was effective in providing a fire resistant fabric and was less costly in preparing. In addition, the fabric had a better feel.

EXAMPLE II

An intimate blend of the present invention from 50% PVC; 10% PANOX (1.5 dpf 1.5 in crimped staple fibers); 10% Kevlar and 30% Fortrel 398 polyester was prepared. The blend was sprayed with antimony oxide and meltspun into a non-woven fabric. The fabric had an L.O.I. of at least 26.5 and was self-extinguishing.

EXAMPLE III

Lightweight non-woven fabrics were made from the following blends and subjected to the non-flammability test described in Example I:

| | Blend | Weight | Char Length |
|---|---|---|---|
| A | 60% PVC | 2.0 oz/yd | 4" sp* |
| | 10% Kevlar | | |
| | 30% Polyester | | |
| B | 65% PVC | 2.5 oz/yd | 3.25" up** |
| | 10% Kevlar | 2.5 oz/yd | 3.5" sp* |
| | 25% Polyester | | |

-continued

| | Blend | Weight | Char Length |
|---|---|---|---|
| C | 50% PVC | 3.0 oz/yd | 3.75" sp* |

*slightly pressed
**unpressed

What is claimed is:

1. A fire resistant, non-dripping, compression formed fusion bonded, non-woven fabric or fabric structure comprising a synergistic blend of about 35 to 80% by weight of chlorine-containing fire retarding polymeric fibers, about 2 to 25% by weight of non-fusing fibers and about 10 to 55% by weight of polyester.

2. The fabric or fabric structure of claim 1 wherein said non-fusing fibers are selected from the group consisting of oxidized polyacrylonitrile fibers, aramid fibers, and polybenzamidazole.

3. The fabric or fabric structure of claim 2 wherein said non-fusing fibers comprise poly (p-phenylene terephthalamide)

4. The fabric or fabric structure of claim 2 comprising about 15% by weight of stabilized polyacrylonitrile fibers.

5. The fabric or fabric structure of claim 1 including an inorganic powder selected from the group consisting of antimony oxide and aluminum trihydrate.

6. The fabric or fabric structure of claim 1 wherein said chlorine containing polymer is selected from the group consisting of polyvinylidene dichloride, chlorinated polyethylene, and polyvinyl chloride.

7. The fabric or fabric structure of claim 6 wherein said chlorine-containing fibers comprise polyvinyl chloride fibers.

8. The fabric or fabric structure of claim 1 wherein non-fusing fibers are crimped.

9. The fabric or fabric structure of claim 1 comprising a plurality of plies.

10. The fabric or fabric structure of claim 1 comprises up to 15% by weight of a non-fusing fiber which is an aramid.

11. The fabric or fabric structure of claim 10 wherein said aramid is poly (p-phenylene terephthalamide).

12. The fabric or fabric structure of claim 10 including up to 30% of a non-fusing fiber which is fiberglass.

13. The fabric or fabric structure of claim 7 comprising about 40 to 70% by weight of said polyvinyl chloride fibers.

14. The fabric or fabric structure of claim 1 wherein said non-fusing fiber is fiberglass.

15. The fabric or fabric structure of claim 14 wherein the fiberglass is sized with a thermoplastic resin.

16. The fabric or fabric structure of claim 14 wherein the fiberglass is crimped.

17. A fire resistant, non-dripping, compression formed fusion bonded non-woven fabric comprising a synergistic blend of about 35 to 80% by weight of polyvinyl chloride, about 2 to 25% of oxidized polyacrylonitrile fibers and about 10 to 55% by weight of a polyester fiber having a softening temperature between about 125° and 200° C.

* * * * *